US005102200A

United States Patent [19]

Woody

[11] Patent Number: 5,102,200

[45] Date of Patent: Apr. 7, 1992

[54] IMPACT RIPPER APPARATUS

[75] Inventor: Albert L. Woody, Dunlap, Ill.

[73] Assignee: Caterpillar Inc., Peoria, Ill.

[21] Appl. No.: 767,353

[22] Filed: Sep. 30, 1991

Related U.S. Application Data

[63] Continuation of Ser. No. 533,205, Jun. 4, 1990, abandoned.

[51] Int. Cl.[5] ..... B25D 17/24; E21C 3/04

[52] U.S. Cl. ..... 299/37; 173/162.1

[58] Field of Search ..... 173/139, 162.1, 162, 173/22; 125/40, 41; 299/37

[56] References Cited

U.S. PATENT DOCUMENTS

| | | | |
|---|---|---|---|
| 3,292,976 | 12/1966 | Leavell | 125/40 X |
| 3,437,381 | 4/1969 | Bodine | 299/37 |
| 3,828,951 | 8/1974 | Fleming | 299/37 X |
| 3,881,554 | 5/1975 | Cooley et al. | 173/162.1 X |
| 4,014,392 | 3/1977 | Ross | 173/139 X |
| 4,257,648 | 3/1981 | Bodine | 299/37 |
| 4,724,912 | 2/1988 | Miyazaki et al. | 173/162.1 |
| 4,906,049 | 3/1990 | Anderson | 299/37 |
| 4,984,850 | 1/1991 | Jensen | 173/139 |
| 5,018,792 | 5/1991 | Roussin et al. | 173/162.1 |

*Primary Examiner*—Douglas D. Watts
*Assistant Examiner*—Rinaldi Rada
*Attorney, Agent, or Firm*—Calvin E. Glastetter

[57] ABSTRACT

Impact rippers are useful for transmitting high impact blows to a hard material for fracturing the material. When a linear reciprocating ram is used a mounting arrangement which maintains the ram in a neutral position, when no force is applied to the tip, must be used to divert impact force into a pivoting shank assembly. The subject impact ripper apparatus includes a shank assembly with an impact surface and a cavity for mounting a linear ram having an impact surface. Means positions the linear ram within the cavity so that the impact surface does not extend outwardly beyond a rear impact surface of the shank assembly when no force (F) is applied to the tip. This arrangement provides for diverting impact force into the shank assembly when no force is applied to the tip.

8 Claims, 3 Drawing Sheets

IMPACT RIPPER APPARATUS

This is a continuation of Ser. No. 07/533,205, filed June 4, 1990, now abandoned.

TECHNICAL FIELD

This invention relates to an impact ripper apparatus and more particularly to an arrangement for preventing damage to the ripper tip retaining pin.

BACKGROUND ART

Impact rippers having reciprocating linear rams are commonly used to deliver high energy impact blows to material to be fractured, such as rock, coal, shale, cement, and so forth. One example of such use involves positioning a linear ram within a cavity of a tool holder for supporting and guiding the linear ram. The linear ram when in the neutral position extends rearward beyond the tool holder. The extending portion has an impact surface which is impacted by the piston of the impact hammer. The impact will propel the linear ram forward to fracture the material. A problem associated with such an arrangement is when no force or load is applied to the ripper tip and the impact hammer is actuated. Without a force on the tip the linear ram will be driven forward until the stop on the linear ram contacts the stop on the tool holder. The forward inertia of the linear ram will be abruptly stopped, but the tip will continue forward putting a bending force on the pin which retains the tip on the linear ram. Repeated impacting without a load on the ripper tip will damage the pin and allow the tip to separate from the linear ram. Another problem associated with such an arrangement is the stop on the linear ram or the stop on the tool holder will also be damaged.

The present invention is directed to overcome one or more of the problems as set forth above.

DISCLOSURE OF THE INVENTION

An impact ripper apparatus includes a mounting frame. A shank assembly has a first end attached to the mounting frame and a second end projecting downwardly from the mounting frame. The second end has a material engaging surface, an impact surface, and a cavity extending therebetween. A linear ram is movably supported within the cavity. A means positions the linear ram within the cavity so that the linear ram does not extend outwardly beyond the impact surface of the shank assembly when in the neutral position. An impact hammer is attached to the mounting frame. The impact hammer has a piston arranged to deliver impact blows to one of the impact surface of the shank assembly and the impact surface of the linear ram.

The present invention provides an impact ripper apparatus having an improved mounting arrangement for positioning the linear ram within the cavity of the shank assembly. Means is used to position the linear ram so that the linear ram does not extend outwardly beyond the impact surface of the shank assembly, but still allow linear movement of the ram. This permits the linear ram to move into position to be impacted when a load is applied to the tip. When no load is present on the tip the linear ram is maintained in a neutral position wherein the impact surface is positioned within the cavity and the force of the impact blows is directed into the shank assembly.

BEST MODE FOR CARRYING OUT THE INVENTION

Figure 1:
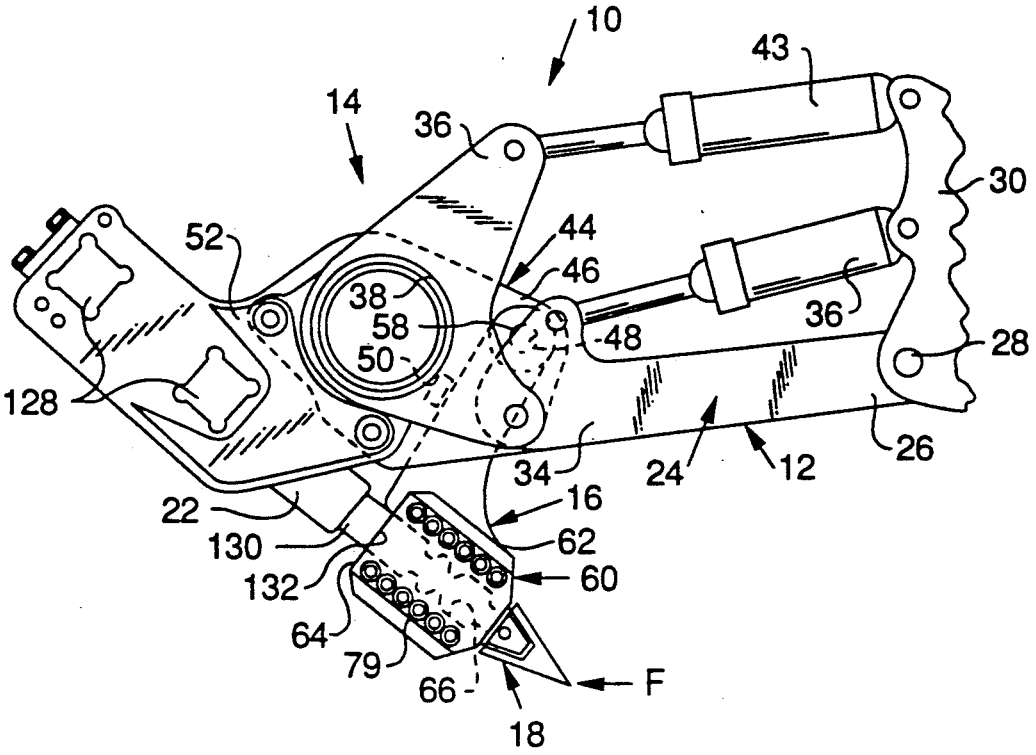
FIG. 1 is a side view of an impact ripper apparatus showing the embodiment of the present invention.
Figure 2:
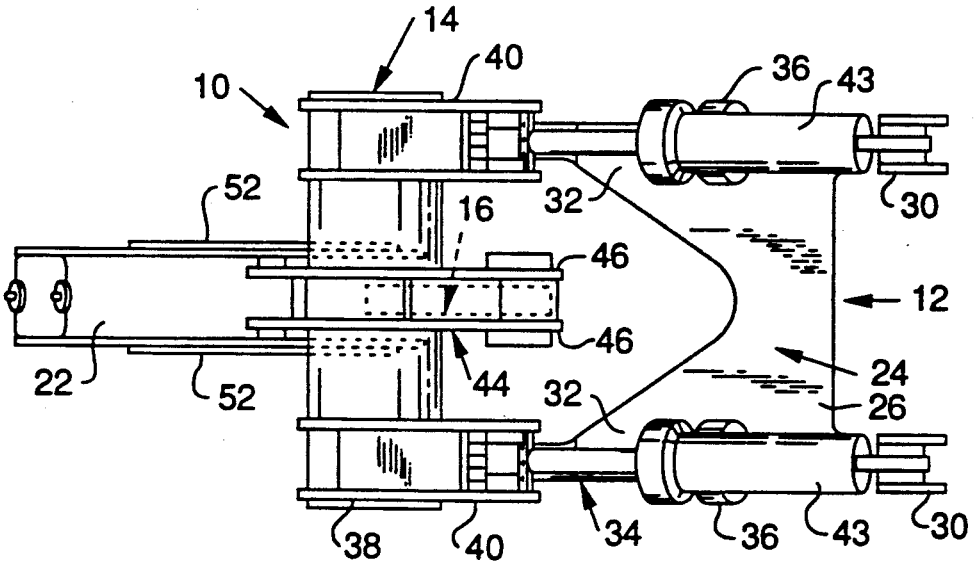
FIG. 2 is a plan view of the impact ripper apparatus of FIG. 1.
Figure 3:
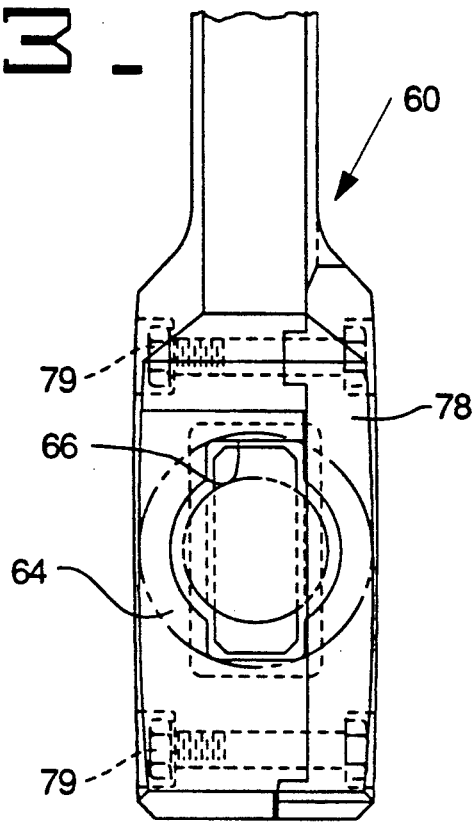
FIG. 3 is an enlarged rear view of a shank assembly showing the present invention.
Figure 4:
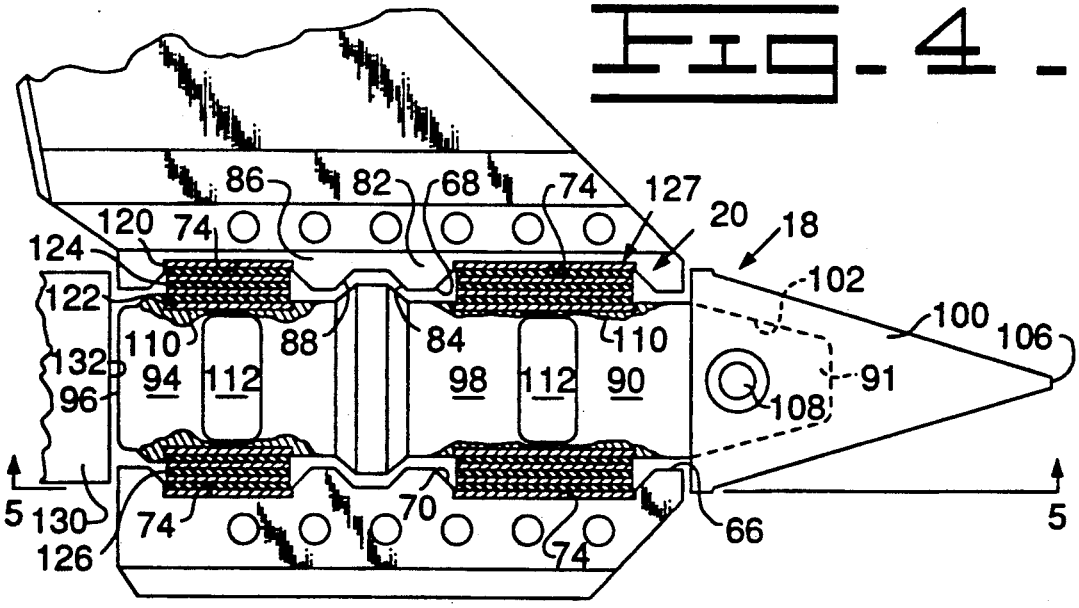
FIG. 4 is a side view of the shank assembly of the present invention with the cover removed to more clearly show the internal parts.
Figure 5:
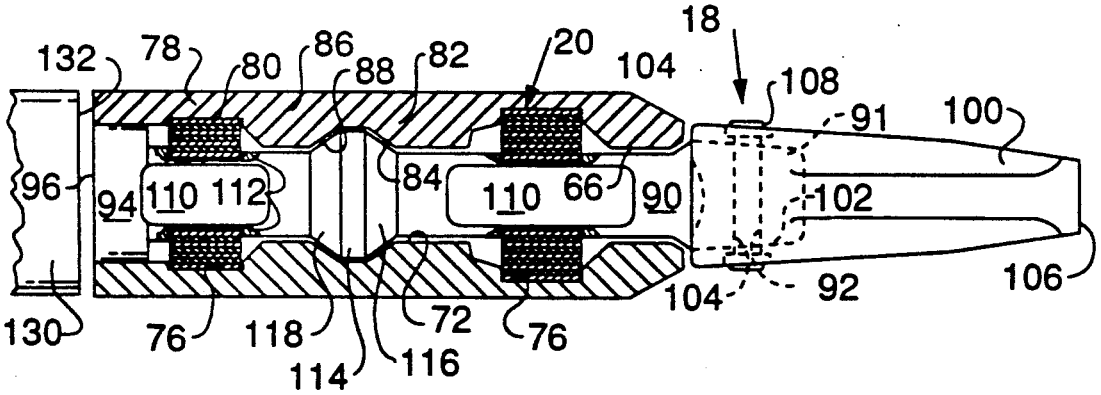
FIG. 5 is a sectional view of the shank assembly taken generally along the line 5—5 in FIG. 4 with the cover attached to show the cooperation of the parts.

An impact ripper apparatus 10 is shown in association with a support structure 12 and includes a mounting frame 14, a shank assembly 16, a linear ram 18, a plurality of rectangular laminated pads 20 and an impact hammer 22.

The support structure 12 includes a support frame 24. The support frame 24 has a first end portion 26 pivotally attached by a pair of pins 28 to a bracket 30 on a vehicle (not shown). The support frame 24 includes a pair of rearwardly projecting transversely spaced legs 32 defining a second end portion 34 of the support frame 24. A pair of hydraulic cylinders 36 extend between the bracket 30 and the second end portion 34 of the support frame 24 to elevationally position the support frame 24.

The mounting frame 14 includes a crossbeam 38 and a pair of end support structures 40 mounted on laterally spaced opposite ends of the crossbeam 38 and being pivotally attached by a pair of pins 42 to the second end portion 34 of the support frame 24. A pair of hydraulic cylinders 43 are positioned between each of the end support structures 40 and the bracket 30 to pivot the mounting frame 14 about the pins 42. The mounting frame 14 further includes a first support structure 44 having spaced support plates 46. The spaced support plates 46 have a pair of aligned holes 48. A stop 50 is positioned between and welded to each of the spaced support plates 46. A pair of spaced apart second support plates 52 are mounted on the mounting frame 14, one on each side of the first support structure 44.

The shank assembly 16 has a first end portion 56 pivotally attached between the spaced first support plates 46 of the first support structure 44 by a pin 58 positioned within the aligned holes 48, and a second end portion 60 projecting downwardly from the mounting frame 14. The second end portion 60 has a material engaging front surface 62 and a rear impact surface 64 having a specified surface area. A cavity 66 in the shank assembly 16 extends from the front surface 62 to the rear impact surface 64. The cavity 66 is defined by an upper surface 68, a lower surface 70, and a side surface 72. The upper and lower surfaces 68, 70 each have a pair of spaced rectangular mounting recesses, as shown by reference numeral 74. The upper and lower rectangular mounting recesses 74 each have the longest length thereof aligned with the longest length of the cavity 66. The side surface 72 has a pair of spaced rectangular mounting recesses, as shown by reference numeral 76. The side rectangular mounting recesses 76 each have the longest length thereof transverse to the longest length of the upper and lower rectangular mounting recesses 74. The second end portion 60 of the shank assembly 16 includes a cover assembly 78 removably attached thereto by a plurality of fastening means, such as bolts 79, to enclose the cavity 66. The cover assembly 78 has a pair of spaced rectangular mounting recesses 80, adjacent the cavity 66, each having the longest length thereof aligned with the longest length of the rectangular mounting recesses 76 in the side surface 72 of the cavity 66. A first annular shoulder 82 positioned between the spaced mounting recesses forms a front thrust surface 84. A second annular shoulder 86 also positioned between the spaced mounting recesses forms a rear thrust surface 88.

The linear ram 18 has a first end portion 90 including a tapered end 91 having a hole 92 therethrough, a second end portion 94 having an impact surface 96 with a specified surface area equal to the specified surface area of the shank, and an intermediate portion 98 positioned within the cavity 66. A material engaging tip 100 having a tapered pocket 102, a pair of spaced apart aligned holes 104, and a point 106 is removably attached to the tapered end 91 by a retainer pin 108 positioned in the aligned holes 104 and the hole 92. The intermediate portion 98 has a pair of upper and a pair of lower rectangular mounting recesses, as shown by reference numeral 110. The rectangular mounting recesses 110 each have the longest length thereof aligned with the longest length of the linear ram 18. The intermediate portion 98 further has a pair of rectangular mounting recesses on each opposed side, as shown by reference numeral 112. The rectangular mounting recesses 112 each have the longest length thereof aligned with the longest length of mounting recesses 76 of the shank assembly 16 and the recesses 80 of the cover assembly 78. The rectangular mounting recesses 112 have the longest length thereof transverse to the longest length of mounting recesses 74. A raised shoulder 114 on the intermediate portion 98 has a front thrust surface 116 and a rear thrust surface 118 which interacts with the front and rear thrust surfaces 84, 88 within the cavity 66 to limit linear movement of the ram 18. The linear ram has a total forward and rearward movement of 10 mm. The linear ram has a 5 mm forward movement or a 5 mm rearward movement from a neutral position.

The plurality of laminated pads 20 are positioned within the cavity 66 between the linear ram 18 and the shank assembly 16 to counteract a force F on the material engaging tip 100. Each of the pads 20 include a first plate 120, a second plate 122, and alternate layers of elastomeric rubber 124 and noncompressable plates 126 bonded between the first and second plates 120, 122. In use, the first plate 120 is positioned within one of the recesses 74, 76 or 80 of the shank assembly 16. The second plate 122 is positioned within the complimentary one of the recesses 110 or 112 of the linear ram 18 for movement with the linear ram 18. The laminated pads 20 provide means 127 for positioning the linear ram 18 in a neutral position within the cavity 66 so that the second end portion 94 does not extend outwardly beyond the impact surface 64 when no force F is present on the material engaging tip 100.

The impact hammer 22 is mounted between the spaced second support plates 52 of the mounting frame 14 by a plurality of resilient mounting assemblies 128. The impact hammer 22 includes a piston 130 having an impact surface 132 with a specified surface area approximately equal to the sum of the specified surface areas of the impact surface 96 of the linear ram 18 and the impact surface 64 of the shank assembly 16.

INDUSTRIAL APPLICABILITY

In use of the present embodiment, the linear ram 18 and the laminated pads 20 are shown in the relaxed or neutral position they would occupy when no force F is applied on the material engaging tip 100. When the linear ram 18 and the pads 20 are in the relaxed condition, the second end portion 94 of the linear ram does not extend outwardly beyond the rear impact surface 64 of the shank assembly 16. When the shank assembly 16 is moved forward into the material being ripped and the tip 100 encounters hard material, a force F is applied to the tip 100. The force F will overcome the resistance of the pads 20 and move the tip 100 and linear ram 18 rearward relative to the shank assembly 16. Thus, the impact surface 96 will be positioned rearwardly of the impact surface 64. The linear ram 18 will continue to move rearward until the rear thrust surface 118 of the linear ram 18 contacts the rear thrust surface 88 of the shank assembly 16. With the rear thrust surfaces 88, 118 in contact, the shank assembly 16 will pivot rearwardly around the pin 58 until the shank assembly 16 contacts the stop 50 on the first support structure 44. With the shank assembly 16 pivoted rearward, the impact hammer 22 is actuated to drive the piston 130 forward causing the impact surface 132 to strike the impact surface 96 of the linear ram 18. The impacting will be repeated until the material fractures. When the material fractures and no force is present on the tip the pads 20 will move the linear ram 18 to the neutral position wherein the impact surface 96 again does not extend rearwardly beyond the impact surface 64. With the impact surface 96 positioned forward within the cavity 66, the impact surface 132 of the piston 130 will strike the impact surface 64 of the shank assembly 16 causing the shank assembly 16 to pivot forwardly around the pin 58.

In view of the foregoing, it is readily apparent that the structure of the present invention provides a shank assembly and linear ram mounting arrangement which diverts the impact force of the impact hammer into the shank assembly when no force is being applied to the tip, but still allows the linear ram to receive full impact force when a force is applied to the tip.

Other aspects, objects, and advantages of this invention can be obtained from a study of the drawings, the disclosure, and the appended claims.

I claim:

1. An impact ripper apparatus comprising:

a mounting frame;

a shank assembly having a first end portion pivotally attached to the mounting frame and a second end portion projecting downwardly from the mounting frame, the second end portion having a front material engaging surface, a rearwardly facing impact surface, and a cavity extending therebetween;

a linear ram movable supported within the cavity and including an end portion having a rearwardly facing impact surface;

means for resiliently positioning the linear ram within the cavity so that in the neutral position when no force is applied to the ram the end portion of the linear ram does not extend rearwardly beyond the rear impact surface of the shank assembly; and an impact hammer attached to the mounting frame and having a piston including a forwardly facing impact surface arranged to deliver forwardly directed impact blows to one of the rearwardly facing impact surface of the shank assembly and the rearwardly facing impact surface of the linear ram.

2. The impact ripper apparatus of claim 1 wherein the means includes a plurality of laminated pads having alternate layers of elastomer and noncompressable plates.

3. The impact ripper apparatus of claim 1 wherein the impact surface of the linear ram has a specified surface area.

4. The impact ripper apparatus of claim 3 wherein the impact surface of the shank assembly has a specified surface area equal to the specified surface area of the linear ram.

5. The impact ripper apparatus of claim 4 wherein the impact surface of the piston has a specified surface area approximately equal to the sum of the specified surface area of the linear ram and the specified surface area of the shank assembly.

6. The impact ripper apparatus of claim 1 wherein the linear ram has a specified amount of forward and rearward movement.

7. The impact ripper apparatus of claim 6 wherein the linear ram has rearward movement of approximately half the specified amount from the neutral position.

8. The impact ripper apparatus of claim 7 wherein the linear ram has a forward movement of approximately half the specified amount from the neutral position.

* * * * *